US005890821A

United States Patent [19]

Lesniak et al.

[11] Patent Number: 5,890,821

[45] Date of Patent: Apr. 6, 1999

[54] PRINT MEDIA EJECTION KICKING AFTER PAPER DROP

[75] Inventors: Christopher M Lesniak, Vancouver; Donald R Bloyer, Brush Prairie; Rick M Tanaka, Vancouver, all of Wash.

[73] Assignee: Hewlett-Packard Company, Palo Alto, Calif.

[21] Appl. No.: 21,975

[22] Filed: Feb. 11, 1998

Related U.S. Application Data

[63] Continuation of Ser. No. 876,312, Jun. 16, 1997, Pat. No. 5,758,981.

[51] Int. Cl.[6] ..... B41J 11/58

[52] U.S. Cl. ..... 400/625; 347/104; 271/10.01; 271/308

[58] Field of Search ..... 400/579, 624, 400/625; 347/104; 271/10.01, 18, 109, 114, 119, 307, 308

[56] References Cited

U.S. PATENT DOCUMENTS

| | | | |
|---|---|---|---|
| 4,452,543 | 6/1984 | Adkisson et al. | 400/605 |
| 5,215,394 | 6/1993 | Kim | 400/625 |
| 5,226,743 | 7/1993 | Jackson et al. | 400/625 |
| 5,299,875 | 4/1994 | Hock et al. | 400/625 |
| 5,420,621 | 5/1995 | Richtsmeier et al. | 347/104 |
| 5,421,661 | 6/1995 | Alzawa et al. | 400/625 |
| 5,427,462 | 6/1995 | Jackson et al. | 400/625 |
| 5,480,238 | 1/1996 | Nakano et al. | 400/625 |
| 5,758,981 | 6/1998 | Lesniak et al. | 400/625 |

*Primary Examiner*—Christopher A. Bennett

[57] ABSTRACT

A print media ejection system actively pushes a media sheet trailing edge into an output tray. The ejection system includes a movable pivot which supports a media sheet within a print zone during printing. Upon completion of printing the pivot moves downward allowing the current media sheet to slide from the pivot into the output tray. After the pivot completes the downward rotational stroke, the pivot rotates back upward to be in position to support the next media sheet. The upward motion of the pivot mechanism actuates a kicker device to rotate toward an output region. The kicker device drives any remaining portion of the media sheet into the output tray.

19 Claims, 5 Drawing Sheets

FIG. 6
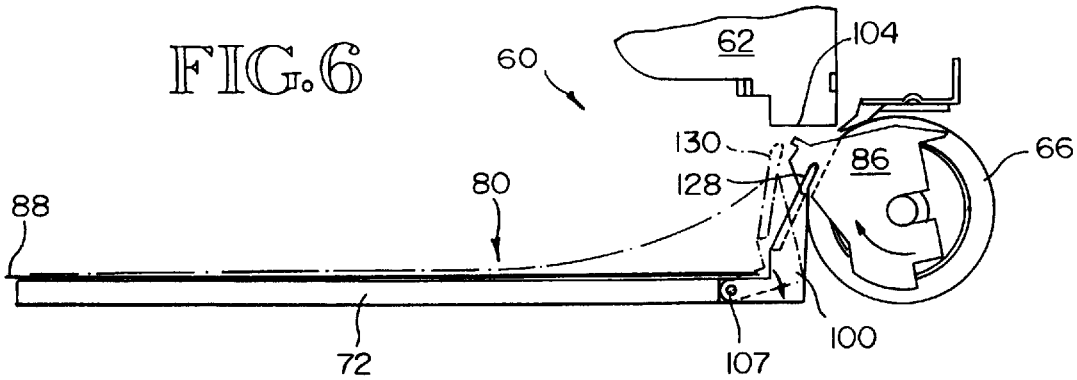
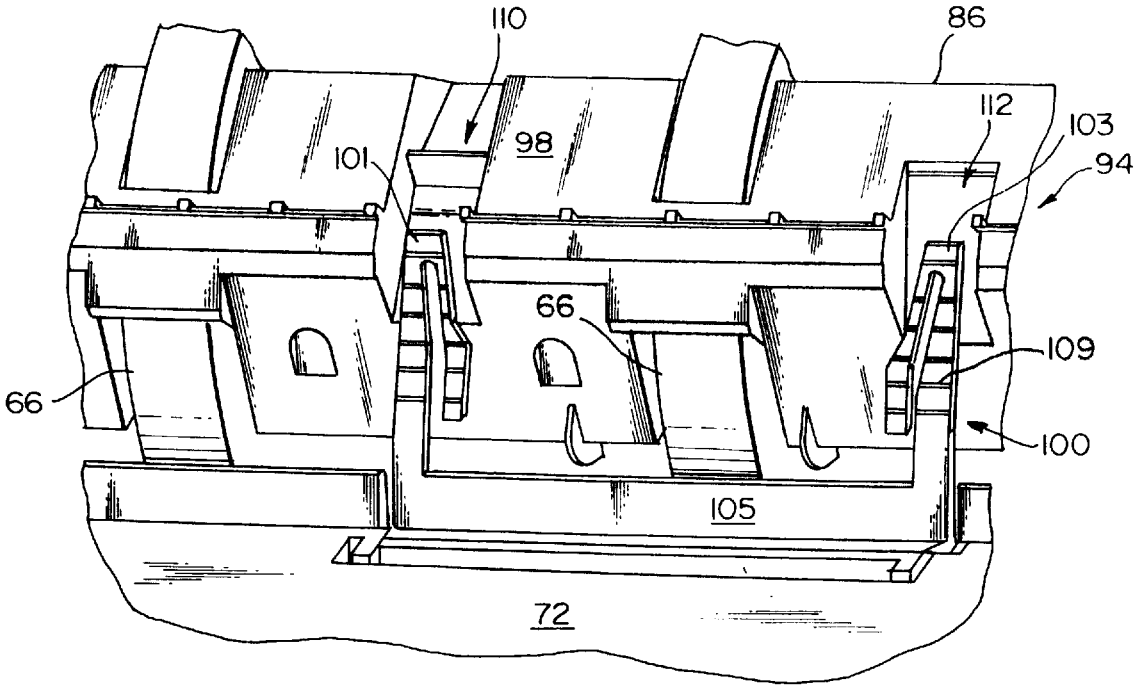
FIG. 7

PRINT MEDIA EJECTION KICKING AFTER PAPER DROP

CROSS REFERENCE TO RELATED APPLICATION

This is a continuation of U.S. patent application Ser. No. 08/876,312 filed Jun. 16, 1997 for Print Media Ejection Kicking After Media Drop , now issued U.S. Pat. No. 5,758,981." The content of that application is incorporated herein by reference and made a part hereof.

BACKGROUND OF THE INVENTION

This invention relates generally to printers, and more particularly to media ejection systems for stacking media sheets in an output region or output tray.

Print jobs commonly include multiple pages fed along a media handling system through a print zone into an output tray or output region. Pages are fed in series with one page along the media path at a time for some printers or with multiple pages along the media path at a time for other printers. Pages are stacked in the output tray. Many printers simply rely on gravity to stack the media sheets as the media sheets exit the media path. One solution has been to push new pages on top of previous pages resting in the output tray. Many laser printers, for example, use this method. A disadvantage of this technique is that pinch rollers often are needed to actively drive the current media sheet all the way along the previous sheet. For inkjet printers, this is undesirable because the previous sheet may still be wet. Starwheels have been used in place of the pinch rollers, but the star wheels can leave tracks on the current media sheet.

The Hewlett-Packard DESKJET® Series printers include a movable pivot in the vicinity of the output tray and the inkjet pen cartridge. The pivot supports the media sheet beneath the inkjet pen as the media sheet passes through the print zone toward the printer's output region. Rail extensions (also referred to as wing devices) are included in the output region. As the media sheet passes from the print zone along the pivot into the output region, the leading edge is pushed onto rail extensions in the output region. The rail extensions receive the current media sheet and support the sheet above the previous media sheets in an underlying output tray. As the printing onto the media sheet completes, a sequence commences in which the pivot and rail extensions move down. The movement (or retraction) of the rail extensions causes the media sheet to fall into the output tray onto the previous media sheet. The movement of the pivot allows the trailing portion of the media sheet to slide from the pivot into the output tray under the force of gravity.

U.S. Pat. No. 5,226,743 issued Jul. 13, 1993 for "Method and Apparatus for Paper Control in a Printer," assigned to Hewlett-Packard Company discloses finger devices used during ejection. As printing onto the media sheet completes, a sequence commences in which a pivot rotates downward and wings retract. A pair of finger devices are pivotally attached to the underside of the pivot. The pivot includes openings for the finger devices. As the platen rotates down, the finger devices rotate up through the openings into contact with the trailing edge of the media sheet. As the media sheet falls from the wings and slides from the pivot, the finger devices give the media sheet a boost. Specifically, the finger devices urge the media sheet into the output tray onto any previous media sheets. Coordinating the movement of the finger devices and pivot adds complexity to the pivot design, requiring several parts (e.g., cam and spring and finger) for the actuation method.

SUMMARY OF THE INVENTION

According to the invention, a print media ejection system actively pushes a media sheet trailing edge into an output tray. The ejection system includes a movable pivot mechanism which supports a media sheet within a print zone during printing. Upon completion of printing the pivot moves downward allowing the current media sheet to slide from the pivot into an output tray. After the pivot completes the downward rotational stroke, the pivot rotates back upward to be in position to support the next media sheet. Rail extensions are included over the output tray for supporting the media sheet above the output tray as the media sheet moves through a print zone into an output region of the printer. A kicker device pushes into the output tray any portion of the media sheet remaining on the pivot mechanism after the print cycle.

According to one aspect of the invention, the media sheet first is dropped from the rail extensions into the output tray before the kicker device is actuated. The contact between the media sheet and a prior media sheet or output tray provides some drag which reduces forward momentum of the media sheet.

According to another aspect of the invention, the upward motion of the pivot mechanism actuates a kicker device. The kicker device rotates toward the output region. The kicker device drives the trailing edge of a current media sheet into the output tray. An advantage of actuating the kicker device during the upward stroke of the pivot, instead of during the downward motion of the pivot, is that the forward momentum of the media sheet is reduced. Previously, the gravitational force on the media sheet as it slides, plus the concurrent finger force on the media sheet during the downward pivot stroke accumulated to be a force which in some instances caused the current media sheet to sail out of the output tray (e.g., onto the floor). By kicking instead during the upward stroke a portion of the media sheet already is resting in the output tray. The force on the media sheet is less. As a result, the likelihood of sailing is reduced.

According to another aspect of the invention, the kicker device is mounted apart from the pivot mechanism, and has an axis of rotation which is not on a portion of the pivot mechanism. The kicker device is biased into a resting position, either by gravity or a spring. The kicker device includes a bendable portion which is able to deflect relative to the remainder of the kicker device. The bendable portion is biased to a first position.

During printing the pivot mechanism is oriented to have a support surface adjacent to the print zone. The kicker device is recessed within a slot along the pivot mechanism. According to another aspect of the invention, during the downward rotation of the pivot mechanism, a portion of the pivot mechanism comes into contact with the bendable portion of the kicker device. The pivot mechanism deflects the kicker device bendable portion allowing the pivot mechanism to continue its downward stroke. The kicker remains in its resting position throughout the downward stroke. At a point along the downward stroke the pivot mechanism moves past the bendable portion of the kicker device. As the pivot mechanism clears the bendable portion, such bendable portion returns to its first position.

According to another aspect of the invention, during the upward stroke of the pivot mechanism, the pivot mechanism again contacts the kicker device. The pivot mechanism does not deflect the bendable portion relative to the rest of the kicker during the upward stroke. Instead, the pivot mechanism pushes the kicker device from its resting position.

Specifically, the upward motion of the pivot mechanism forces the kicker device to rotate toward any previous media sheets in the output tray. The movement of the kicker pushes any remaining portions of the current media sheet from the pivot mechanism onto the stack in the output tray. An advantage of this invention is that the kicker device does not even contact the media sheet when the media sheet properly falls into the output tray during the downward stroke of the pivot mechanism. In such case the kicker moves but the media sheet is not on the pivot mechanism to be pushed into the output tray. It is during the instances where the trailing portion remains on the pivot mechanism that the kicker pushes the media sheet into the output tray. The kicker device serves to prevent the trailing edge of the media sheet from getting stuck on the pivot mechanism. A media sheet that gets stuck on the pivot mechanism may interfere with printing to the next media sheet. For example, the media sheet can come into contact with the inkjet pen printhead and block ink to the next sheet. The media sheet's contact with the printhead may damage or clog printhead nozzles. The media sheet also may smear ink printing onto the subsequent sheet. The interference can damage the media sheet or the ensuing media sheet. Thus, it is highly desirable to assure that the media sheet is moved away from the print zone into the output tray after printing is complete. Another advantage is that the media sheet is moved off the pivot in a manner that avoids sailing the media sheet out of the output tray. By moving the media sheet off the pivot mechanism into the output tray, the media sheet does not block the path of a subsequent media sheet. The benefit of being out of the path of the subsequent media sheet is that the subsequent media sheet does not push the trailing edge of the media sheet, and in effect, push the prior media sheet out of the output tray onto, for example, the floor or table top.

These and other aspects and advantages of the invention will be better understood by reference to the following detailed description taken in conjunction with the accompanying drawings.

BRIEF DESCRIPTION OF THE DRAWINGS

FIG. 6 is a diagram of the inkjet printer portion of FIG. 3 in which the support pivot mechanism has cleared the kicker mechanism during an upstroke;

FIG. 7 is a partial isometric view of the support pivot mechanism and kicker mechanism according to an embodiment of this invention showing the support pivot mechanism in its first position and the kicker mechanism in its first position;

DESCRIPTION OF SPECIFIC EMBODIMENTS

Overview—Conventional Ejection Process

Figure 1:
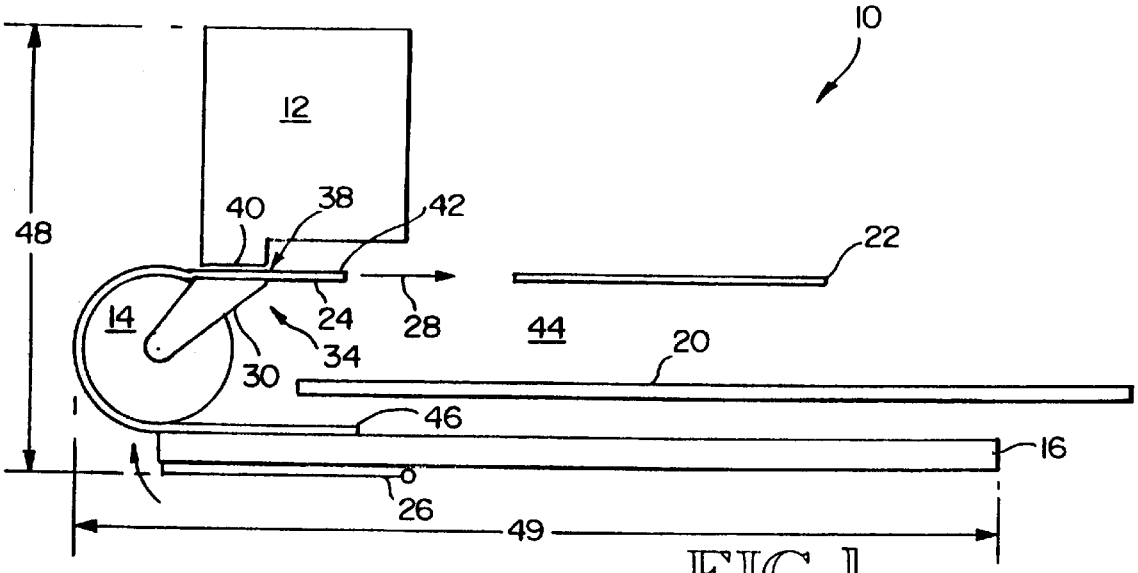
FIG. 1 PRIOR ART
FIG. 1 is a diagram of a portion of a conventional inkjet printer having a conventional pivot mechanism in a first position adjacent to a printhead.
Figure 2:
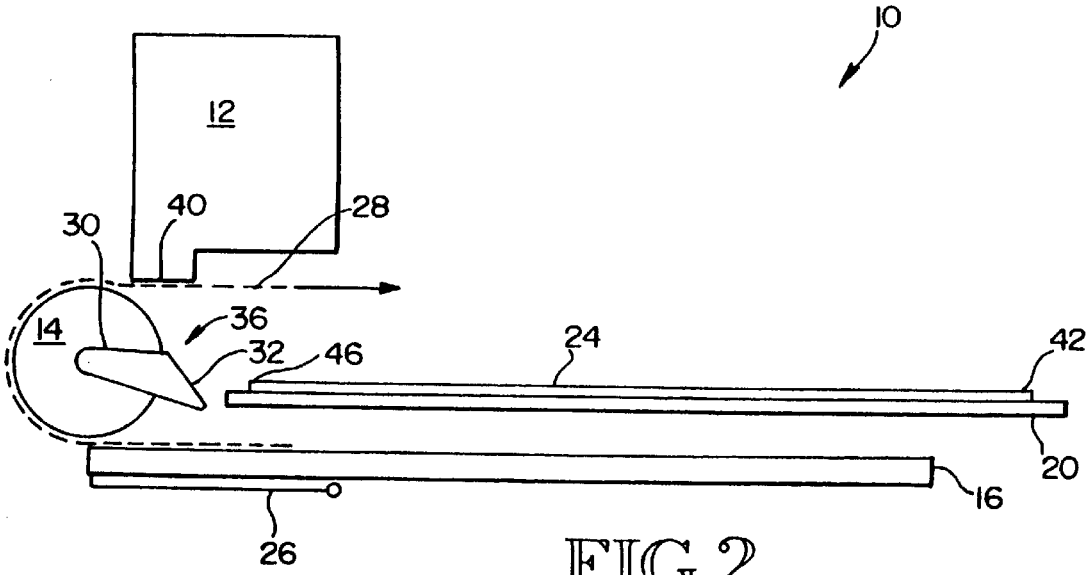
FIG. 2 PRIOR ART
FIG. 2 diagram of the inkjet printer portion of FIG. 1 in which the conventional pivot mechanism is in a second position away from the printhead.

FIG. 1 shows a portion 10 of a conventional inkjet printer having an inkjet pen 12, a pick and feed roller 14, an input tray 16, an output tray 20 and rail extensions 22. To print to a media sheet 24 the media sheet is picked from the input tray 16. At the start of the pick cycle a pressure plate 26 rises to lift the input paper stack in the input tray 16 toward the pick and feed roller 14. The pick and feed roller 14 picks the top media sheet 24 and moves the media sheet 24 along a media path 28. A conventional pivot mechanism 30 is coupled to the roller 14. The pivot mechanism 30 moves between a first position 34 (as shown in FIG. 1) and a second position 36 (as shown in FIG. 2). The pivot mechanism includes a support surface 32.

While the inkjet pen 12 prints to the media sheet 24, the pivot mechanism 30 is in the first position 34. While in the first position 34, a print zone 38 is formed between the support surface 32 and the inkjet pen's printhead 40. As the media sheet 24 moves along the media path 28, a changing portion of the media sheet 24 moves into the print zone 38 to receive ink. After passing through the print zone 38, a lead edge 42 of the media sheet 24 moves into an output area 44 where the rail extensions 22 and output tray 20 are located. The lead edge 42 moves onto the rail extensions 22 and is held above the output tray 20. As the print cycle continues more and more of the media sheet 24 moves along the rail extensions 22 above the output tray 20. The purpose of the rail extensions 22 is to elevate the currently printing media sheet 24 above a stack of previously printed media sheets. By doing so, the media sheet at the top of the stack is given more time to dry. This prevents the currently printing media sheet 24 from smearing a previously printed media sheet.

Once the trailing edge 46 of media sheet 24 moves off the feed roller 14, the pivot mechanism 30 begins to move to the second position 36 (see FIG. 2). In addition, the rail extensions 22 retract. The media sheet 24 slides from the support surface 32 and falls from the rail extensions 22 into the output tray 20. The absence of the rail extensions 22 from the diagram of FIG. 2 represents the retraction of the rail extensions 22. The pivot mechanism 30 moves in a continuous manner when moving from the first position 34 to the second position 36. Similarly, the rail extensions 22 retract in a continuous manner when releasing the media sheet 24 to the output tray 20.

Overview—Media Handling and Ejection System

Figure 3:
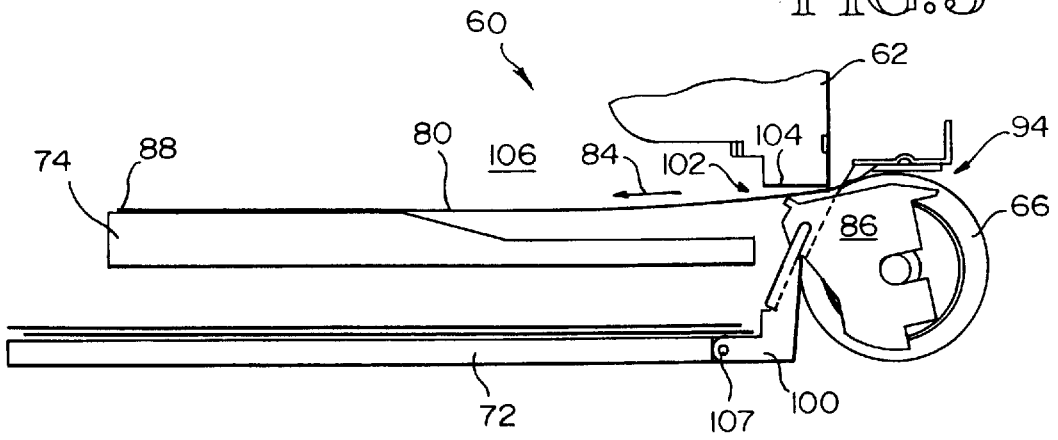
FIG. 3 is a diagram of a portion of an inkjet printer according to an embodiment of this invention, in which a support pivot mechanism is in a first position adjacent to a printhead.

FIG. 3 is a diagram of a portion 60 of an inkjet printer according to an embodiment of this invention. The portion 60 of the inkjet printer illustrated includes an inkjet pen 62, a feed roller 66, an output tray 72 and rail extensions 74. To print to a media sheet 80 the media sheet is picked and fed onto the roller 66 and moved along a media path toward a print zone 102.

Figure 4:
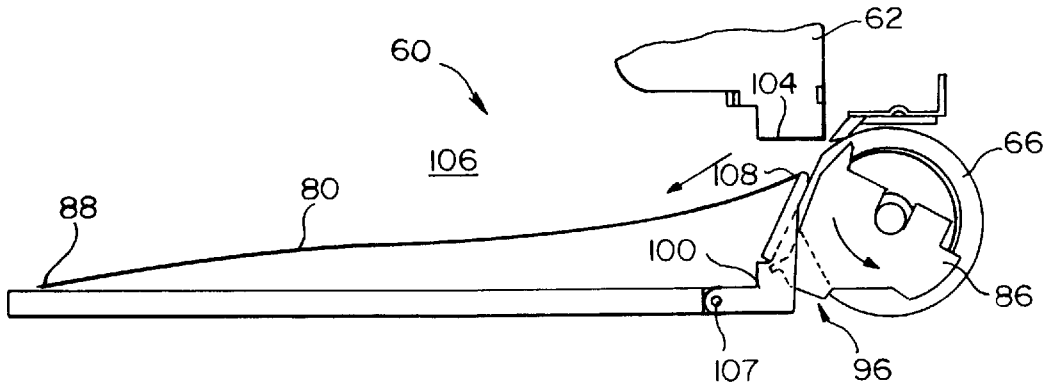
FIG. 4 is a diagram of the inkjet printer portion of FIG. 3 in which the support pivot mechanism is in a second position.

A support pivot mechanism 86 is coupled to the feed roller 66. The support pivot mechanism 86 moves between a first position 94 (as shown in FIG. 3) and a second position 96 (as shown in FIG. 4). While the inkjet pen 62 prints to the media sheet 80, the pivot mechanism 86 is in the first position 94. While in the first position 94, a print zone 102 is formed between a support surface 98 (see FIG. 7) of the support pivot mechanism 86 and the inkjet pen's printhead 104. The support surface 98 extends the width of the media path. The pivot mechanism 86 is coupled to a drive motor which also drives the roller 66. A clutch engages the pivot to the drive motor upon the completion of a print cycle, to cause the support pivot mechanism 86 to move with the rotation of the roller 66.

During printing, as the media sheet 80 moves along the media path, a changing portion of the media sheet 80 moves into the print zone 102 to receive ink. The lead edge 88 of the media sheet 80 moves into an output area 106 where the rail extensions 74 and output tray 72 are located. The lead edge 88 moves onto the rail extensions 74 and is held above the output tray 72. As the print cycle continues more and more of the media sheet 80 moves along the rail extensions 74. The purpose of the rail extensions is to elevate the currently printing media sheet 80 above a stack of previously printed media sheets. By doing so, the prior printing media sheet is given more time to dry before the current media sheet is placed on the stack. This prevents the currently printing media sheet 80 from smearing on the previously printed media sheet in the output tray.

Once the trailing edge 108 of media sheet 80 moves out of the grasp of a pinch roller (not shown) and the feed roller 66, the pivot mechanism 86 moves away from the first position 94 toward the second position 96. In addition, the rail extensions 74 retract. FIG. 4 shows the media sheet 80 having completed printing and the support pivot mechanism 86 moving downward into the second position 96.

In a preferred embodiment there are two rail extensions 74. Each extension 74 rotates between a down, extended position, and an up, retracted position. An axis of rotation for a given extension 74 is defined between the extension 74 and printer walls adjacent to the output tray. The pivot mechanism 86 extends into contact with a portion of each respective rail extension 74. While the pivot mechanism 86 is in the first position 94, the portions are above the rail extension. As the pivot mechanism 86 moves downward, mechanism 86 rotates the rail extensions 74 upward from the extended position toward a retracted position. Similarly as the pivot mechanism moves up to the support's first position 94, the pivot mechanism rotates the rail extension mechanisms 74 downward into an open position. The rail extensions mechanisms 74 are shown in FIG. 3 and omitted from FIGS. 4, 5 and 6.

Figure 5:
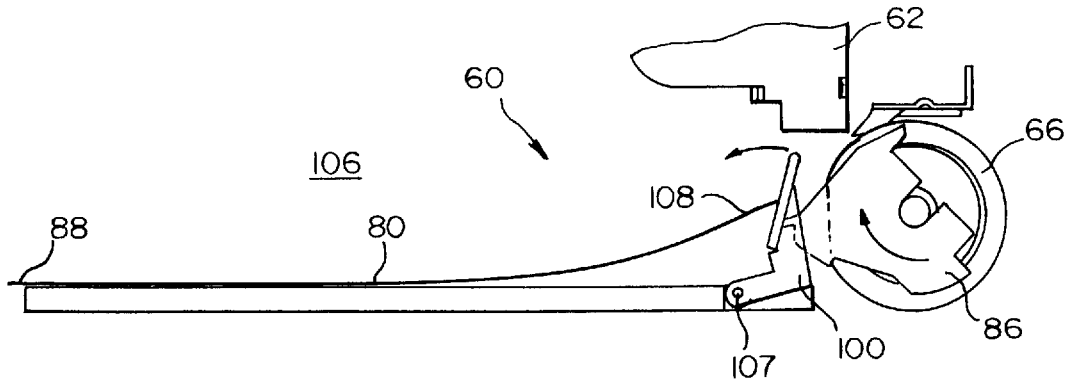
FIG. 5 is a diagram of the inkjet printer portion of FIG. 3 in which the support pivot mechanism is moving away from the second position of FIG. 4.

According to an aspect of this invention a kicker mechanism 100 is included to push the trailing portion of the media sheet 80 into the output tray 72. The kicker mechanism 100 is separate from the support pivot mechanism 86. The kicker mechanism 100 moves between a first position 128 and a second position 130 (see FIG. 6), and is biased by gravity or spring to the first position. The kicker mechanism 100 rotates about an axis point 107. In an exemplary embodiment the kicker mechanism is coupled to the output tray 72 at the axis point 107. In other embodiments the kicker mechanism is mounted to the printer housing, a frame, casing or other component excluding the support pivot mechanism 86. In a preferred embodiment the support pivot mechanism 86 pushes the kicker mechanism 100 from the first position to the second position during the return upstroke of the support pivot mechanism from the support's second position 96 back to the support's first position 94 as shown in FIG. 5. Once the support pivot mechanism 86 clears the kicker mechanism 100, the kicker mechanism 100 returns to its first position as shown in FIG. 6. In an alternative embodiment the support pivot mechanism 86 pushes the kicker mechanism 100 from the first position to the second position during the down stroke of the support pivot mechanism, but not until after the rail extensions 74 have retracted enough to allow at least a portion of the media sheet 80 to fall into the output tray 72.

Kicker Operation

Figure 8:
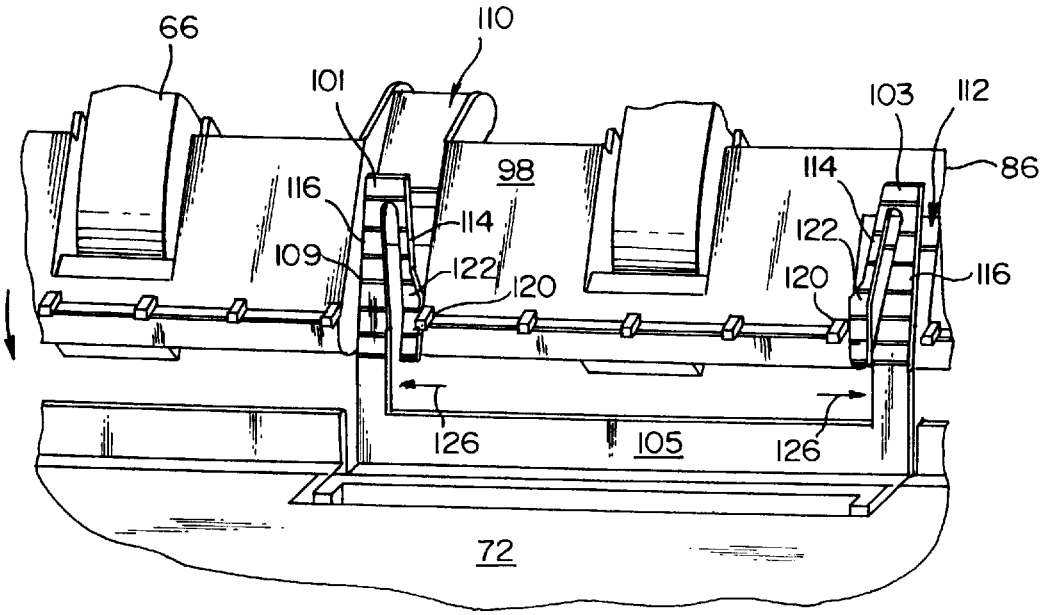
FIG. 8 is a partial isometric view of the support pivot mechanism and kicker mechanism of FIG. 7 showing the support pivot mechanism moving away from its first position and compressing cantilevered portions of arms of the kicker mechanism.
Figure 9:
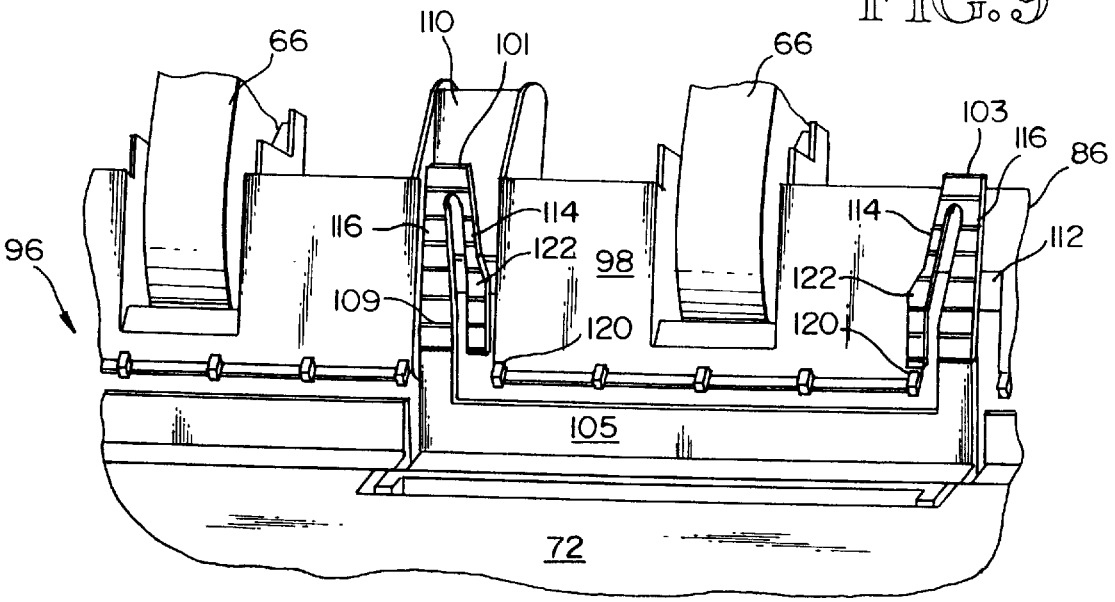
FIG. 9 is a partial isometric view of the support pivot mechanism and kicker mechanism of FIG. 7 showing the support pivot mechanism in its second position and the kicker echanism in its first position.

FIGS. 7–9 show the interrelation of the support pivot mechanism 86 and the kicker mechanism 100. Referring to FIGS. 7–9 the kicker mechanism 100 includes two arms 101, 103 extending from a common barrier 105. In one embodiment each arm 101, 103 includes a series of grooves 109 at the surface making contact with a media sheet. In an alternative embodiment the surface is textured to reduce sliding of the media sheet relative to the arm. In another embodiment an alternative structure for catching the trailing edge of the media sheet is used. The grooves, textured surface and/or other structure improve the effectiveness of the arm in moving the media sheet off the pivot mechanism into the output tray.

In the embodiment illustrated the kicker mechanism 100 is mounted to the output tray 72. FIG. 7 shows the kicker mechanism 100 and pivot mechanism 86 in their respective first positions ready for a media sheet to enter the print zone 102 and receive ink. In the embodiment illustrated the kicker mechanism 100 is biased by gravity to the kicker mechanism's first position. In an alternative embodiment the kicker is biased by a spring or otherwise moved back to the first position. The kicker arms 101, 103 extend upward from the barrier 105 into respective slots 110, 112 of the pivot mechanism 86. Distal ends of the arms 101, 103 do not extend above the support surface 98 into the print zone 102 (see FIG. 3) during printing. The barrier 105 also serves as a wall portion of the output tray 72.

FIG. 8 shows the support pivot mechanism 86 during its downward stroke from the support's first position 94 toward the support's second position 96. Each arm 101, 103 includes two portions. In the embodiment illustrated a first portion 114 is cantilevered to a second portion 116. The second portion extends from the barrier 105. The first portion 114 is deflectable relative to the second portion 116. In the illustrated embodiment the first portion 114 is compressed relative to the second portion 116 in a spring-like manner. As the support pivot mechanism 86 rotates down, walls of the slots 110, 112 move down the arms 101, 103. At a specific point during the downward motion of the support pivot mechanism 86, a respective portion 120 bordering each slot 110, 112 comes into contact with a protruding section 122 of the first portion 114 of the respective arms 101, 103. The continued motion of the support pivot mechanism 86 downward compresses the first portion 114 relative to the second portion 116 in a respective compressing direction 126. Eventually, as the support pivot mechanism 86 continues its downward stroke the slot border portion 120 clears the arm protruding sections 122 (see FIG. 9) allowing the first portion 114 to return to its relaxed position relative to the second portion 116. FIG. 9 shows the support pivot mechanism at its second position 96 with the portions 120 having cleared the arms 101, 103.

Figure 10:
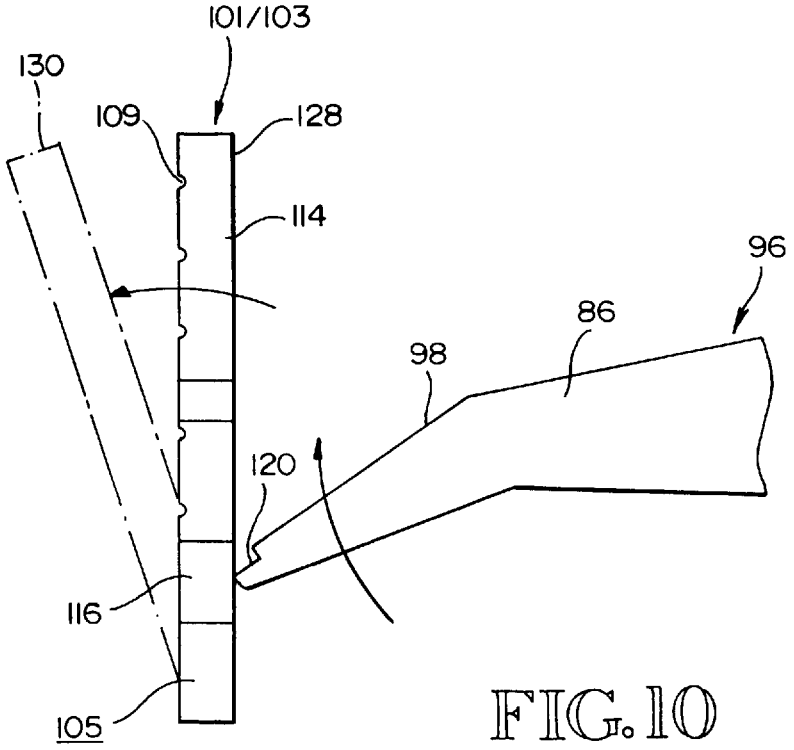
FIG. 10 is a diagram showing the upward motion of the support pivot mechanism of FIG. 7 moving the kicker mechanism toward the kicker's second position according to an embodiment of this invention.

Referring to FIG. 10, as the support pivot mechanism 86 rotates upward from its second position 96 back to its first position 94, the slot border portion 120 pushes against the arm first portion 114 causing the kicker mechanism 100 to rotate from the kicker's first position 128 to the kicker's second position 130. Specifically, the arm 101, 103 first portions 114 are contoured to allow the slot border portion 120 to slide over the protruding section 122 only when the pivot mechanism 86 moves downward. During the upward stroke the border portions 120 push the kicker 100 at the protruding sections 122 of the arms 101, 103. During such kicker motion, the trailing edge of the media sheet 80 if still adjacent to the pivot mechanism 86 is caught in a groove 109 of the kicker arms 101, 103. The motion of the kicker 100 thus pushes the trailing edge 88 and media sheet 80 into the output tray 72.

In an alternative embodiment, the first portion is deflected in another direction either into or away from the path of the pivot mechanism 86, rather than toward the second portion. For example, in a direction perpendicular to the direction of compression in the embodiment of FIGS. 3–6. In still another embodiment the arm 101, 103 include a button which is compressed during the downward motion of the pivot mechanism so as to allow the pivot mechanism to pass. During an upward stroke however, the pivot mechanism 86 instead pushes the kicker mechanism 100 out of its path. In other embodiments there need not be two arms. The kicker instead can include one arm or multiple arms (e.g., 3 or more).

Meritorious and Advantageous Effects

An advantage of the ejection method is that media sheets are moved from the rails to the output tray (i) without the media sheet sailing out of the output tray onto a desktop or floor, and (ii) without the media sheet getting stuck on the pivot mechanism and rail extensions and interfering with subsequent print cycles or media ejection cycles.

Another advantage of this invention is that the kicker device does not even contact the media sheet when the media sheet properly falls into the output tray during the downward stroke of the pivot. In such case the kicker moves but the media sheet is not on the pivot to be pushed into the output tray. It is during the instances where the trailing portion remains on the pivot that the kicker pushes the media sheet into the output tray.

Another advantage of the invention is that the kicking function is achieved with minimal parts resulting in an apparatus that is easy to manufacture. Although a preferred embodiment of the invention has been illustrated and described, various alternatives, modifications and equivalents may be used. Therefore, the foregoing description should not be taken as limiting the scope of the inventions which are defined by the appended claims.

What is claimed is:

1. An apparatus for controlling ejection of a media sheet, comprising:

an output region for receiving media sheets from a media path;

a support which supports an undersurface of a media sheet along a portion of the media path, the support pivoting between a support first position and a support second position;

a projection mounted separate and apart from the support, the projection having an pivot point which is part of the projection and about which the projection is movable between a projection first position and a projection second position;

wherein during a pivot motion of the support from the support second position toward the support first position, the projection moves from the projection first position toward the projection second position.

2. The apparatus of claim 1, in which the projection is biased to the projection first position, and wherein the projection returns to the projection first position after the support clears the projection during the movement of the support from the support second position to the support first position.

3. The apparatus of claim 1, wherein during a pivot motion of the support from the support first position toward the support second position, the support moves past the projection.

4. The apparatus of claim 3, in which the projection comprises a first portion and a second portion, the first portion movable relative to the second portion; and wherein during the pivot motion of the support from the support first position toward the support second position, the support moves the first portion relative to the second portion and moves past the projection without moving the projection from the projection first position toward the projection second position.

5. The apparatus of claim 4, in which the first portion is antilevered relative to the second portion, in which the projection is rotatable between he projection first position and the projection second position about an axis point on the second portion; and wherein during the pivot motion of the support from the support first position toward the support second position, the support deflects the first portion relative to the second portion to move past the projection without moving the projection from the projection first position toward the projection second position, and wherein when the support clears the first portion, the first portion returns to an undeflected rest position.

6. The apparatus of claim 1, wherein during the pivot motion of the support from the support second position toward the support first position, the support pushes the projection from the projection first position toward the projection second position.

7. The apparatus of claim 1, in which the projection moves between the projection first position and the projection second position about an axis of rotation, the axis of rotation located at a point separate from the support.

8. The apparatus of claim 7, further comprising an output tray in the output region, and wherein the projection is coupled to the output tray at the axis of rotation.

9. The apparatus of claim 8, further comprising:

a rail extension mechanism in the output region which initially receives the media sheet from the support, the rail extension mechanism having a rail first position in which the rail extension mechanism supports the media sheet and having a second rail position in which the rail extension mechanism allows the media sheet to fall into the output tray;

wherein during the pivot motion of the support from the support first position toward the support second position, the rail extension mechanism concurrently moves from the rail first position toward the rail second position.

10. A method for ejecting a media sheet into an output tray, comprising the steps of:

moving a media sheet over a support into an output region;

pivotally moving the support from a first position to a second position causing the media sheet to slide farther into the output region;

after the step of moving the support to the support second position, moving the support back to the support first position;

during the step of moving the support back to the support first position, the support contacting a projection forcing the projection from a projection first position toward a projection second position, wherein the movement of the projection from the projection first position to the projection second position pushes a portion of media sheet remaining on the support off the support.

11. The method of claim 10, in which the projection is biased to the projection first position, and wherein the projection returns to the projection first position after the support clears the projection during the movement of the support from the support second position to the support first position.

12. The method of claim 10, in which the projection comprises a first portion and a second portion, the first portion cantilevered relative to the second portion; and wherein during the pivot motion of the support from the support first position toward the support second position, the support moves the first portion relative to the second portion and moves past the projection without moving the projection from the projection first position toward the projection second position.

13. The method of claim 12, in which the projection is rotatable between the projection first position and the projection second position about an axis point on the second portion; and wherein during the pivot motion of the support from the support first position toward the support second position, the support deflects the first portion relative to the second portion to move past the projection without moving the projection from the projection first position toward the projection second position, and wherein when the support clears the first portion, the first portion returns to an undeflected rest position.

14. The method of claim 10, in which the projection is coupled to an output tray in the output region, and wherein during the step of forcing the projection from the projection first position to the projection second position, the projection pushes the portion of media sheet remaining on the support into the output tray.

15. An apparatus for controlling ejection of a media sheet, comprising:

an output region for receiving media sheets from a media path;

a support which supports an undersurface of a media sheet along a portion of the media path, the support pivoting between a support first position and a support second position;

a projection separate from the support movable between a projection first position and a projection second position;

wherein during a pivot motion of the support from the support second position toward the support first position, the projection moves from the projection first position toward the projection second position, wherein the projection is biased to the projection first position, wherein the support enters into contact with the projection during the movement of the support from the support second position to the support first position, and wherein the projection returns to the projection first position after the support clears contact with the projection during the movement of the support from the support second position to the support first position.

16. An apparatus for controlling ejection of a media sheet, comprising:

an output region for receiving media sheets from a media path;

a support which supports an undersurface of a media sheet along a portion of the media path, the support pivoting between a support first position and a support second position;

a projection separate from the support movable between a projection first position and a projection second position;

wherein during a pivot motion of the support from the support second position toward the support first position, the projection moves from the projection first position toward the projection second position, wherein during a pivot motion of the support from the support first position toward the support second position, the support moves past the projection without the projection moving between the projection first position and the projection second position.

17. The apparatus of claim 16, in which the projection comprises a first portion and a second portion, the first portion movable relative to the second portion; and wherein during the pivot motion of the support from the support first position toward the support second position, the support moves the first portion relative to the second portion and moves past the projection without moving the projection from the projection first position toward the projection second position.

18. An apparatus for controlling ejection of a media sheet, comprising:

an output region for receiving media sheets from a media path;

a support which supports an undersurface of a media sheet along a portion of the media path, the support pivoting between a support first position and a support second position;

a projection separate from the support movable between a projection first position and a projection second position;

wherein during a pivot motion of the support from the support second position toward the support first position, the projection moves from the projection first position toward the projection second position, wherein during the pivot motion of the support from the support second position toward the support first position, the support pushes the projection from the projection first position toward the projection second position.

19. An apparatus for controlling ejection of a media sheet, comprising:

an output region for receiving media sheets from a media path;

a support which supports an undersurface of a media sheet along a portion of the media path, the support pivoting between a support first position and a support second position;

a projection separate from the support movable between a projection first position and a projection second position;

wherein during a pivot motion of the support from the support second position toward the support first position, the projection moves from the projection first position toward the projection second position, wherein the projection moves between the projection first position and the projection second position about an axis of rotation, the axis of rotation located at a point separate from the support.

* * * * *

UNITED STATES PATENT AND TRADEMARK OFFICE

CERTIFICATE OF CORRECTION

PATENT NO : 5,890,821

DATED : April 6, 1999

INVENTOR(S) : Lesniak et al.

It is certified that error appears in the above-identified patent and that said Letters Patent is hereby corrected as shown below:

Column 3, (line 44), after "Fig. 2" insert --is a--.
Column 4, (line 7), delete "echanism" and insert therefor --mechanism--.
Column 5, (line 10), after "cycle" delete ",".

IN THE CLAIMS

Column 8, (line 18), delete "antilevered" and insert therefor --cantilevered--.
Column 8, (line 19), delete "he" and insert therefor --the--.

Signed and Sealed this

Seventh Day of December, 1999

*Attest:*

Q. TODD DICKINSON

*Attesting Officer*

*Acting Commissioner of Patents and Trademarks*